US011065480B2

(12) United States Patent
Chen et al.

(10) Patent No.: US 11,065,480 B2
(45) Date of Patent: Jul. 20, 2021

(54) PPE WITH ROTATING ASSEMBLY PROVIDING MULTIPLE FACE COVERS

(71) Applicant: GOLDEN GALAXY CORPORATION, Cupertino, CA (US)

(72) Inventors: Andy Chen, Saratoga, CA (US); Cindy Jingru Wang, Palo Alto, CA (US); Allen Bryan, Redwood City, CA (US); Alisa Zhou, San Rafael, CA (US); Owen Xu Li, Mexico City (MX); Angel Zhou, San Rafael, CA (US)

( * ) Notice: Subject to any disclaimer, the term of this patent is extended or adjusted under 35 U.S.C. 154(b) by 0 days.

(21) Appl. No.: 17/093,213

(22) Filed: Nov. 9, 2020

(65) Prior Publication Data

US 2021/0052922 A1 Feb. 25, 2021

(51) Int. Cl.

| | |
|---|---|
| ***A62B 18/04*** | (2006.01) |
| ***A62B 17/04*** | (2006.01) |
| ***A62B 17/00*** | (2006.01) |
| ***A62B 18/08*** | (2006.01) |
| ***A41D 13/02*** | (2006.01) |
| ***A41D 13/11*** | (2006.01) |
| ***A41D 31/30*** | (2019.01) |
| ***A62B 23/02*** | (2006.01) |

(52) U.S. Cl.

CPC ..... *A62B 18/04* (2013.01); *A41D 13/02* (2013.01); *A41D 13/1153* (2013.01); *A41D 31/30* (2019.02); *A62B 17/001* (2013.01); *A62B 17/006* (2013.01); *A62B 18/08* (2013.01); *A62B 23/02* (2013.01); *A41D 2300/32* (2013.01); *A41D 2300/322* (2013.01); *A41D 2300/324* (2013.01); *A62B 17/04* (2013.01)

(58) Field of Classification Search

CPC ..... A62B 18/00; A62B 18/04; A62B 18/045; A62B 17/001; A62B 17/006; A62B 18/08; A62B 23/02; A62B 17/04; A41D 31/30; A41D 13/02; A41D 13/1153; A41D 2300/32; A41D 2300/322; A41D 2300/324; A41D 13/1218

See application file for complete search history.

(56) References Cited

U.S. PATENT DOCUMENTS

| | | | | |
|---|---|---|---|---|
| 622,677 A * | 4/1899 | Gallagher | ..... | A62B 17/04 128/201.25 |
| 3,432,860 A * | 3/1969 | Durney | ..... | B64G 6/00 2/2.12 |
| 3,529,594 A * | 9/1970 | Charnley | ..... | A41D 13/0025 128/863 |

(Continued)

*Primary Examiner* — Tu A Vo

(74) *Attorney, Agent, or Firm* — Stephen E. Zweig

(57) ABSTRACT

A personal protective device (PPE), which can include a face cover assembly and a bodysuit configured to be worn by a human user. The device protects users against airborne aerosol particles containing viruses or other infectious agents while enabling improved flexibility relative to prior art designs. The device includes a helmet-like" rotating face cover assembly that fits over the user's head and attaches to a collar on the biohazard bodysuit. This rotating face cover assembly has a plurality of different mask sides, each with differing geometries or other properties. The device enables a user to can rotate the cover and select a given mask side that best meets that user's needs. The different mask sides can accommodate different facial geometries, eyewear types, and use cases.

19 Claims, 6 Drawing Sheets

(56) References Cited

U.S. PATENT DOCUMENTS 4,552,140 A * 11/1985 Cowley ..... A62B 17/04 128/201.25
4,683,880 A * 8/1987 Werjefelt ..... A62B 15/00 128/201.23
4,889,113 A * 12/1989 Pelloux-Gervais .... A62B 17/04 128/201.25
5,003,973 A * 4/1991 Ford ..... A42B 3/044 128/201.25
5,226,409 A * 7/1993 Bower ..... A62B 17/04 128/201.23
5,467,765 A * 11/1995 Maturaporn ..... A41D 13/1115 128/206.12
5,819,728 A * 10/1998 Ritchie ..... A62B 17/04 128/201.23
6,460,538 B1 * 10/2002 Kemp ..... A62B 17/04 128/201.22
6,701,920 B1 * 3/2004 Cox ..... A62B 17/04 128/201.22
6,854,459 B1 * 2/2005 Cox ..... A62B 17/04 128/201.22
9,931,482 B2 * 4/2018 Ritchie ..... A61M 16/06
2003/0075174 A1 * 4/2003 Shahaf ..... A61M 16/06 128/201.25
2003/0135915 A1 * 7/2003 Luppi ..... A61M 16/06 2/424
2006/0137686 A1 * 6/2006 Macris ..... A61M 16/06 128/201.22
2008/0105255 A1 * 5/2008 Resnick ..... A62B 18/04 128/201.23
2012/0036622 A1 * 2/2012 Carron ..... A62B 17/005 2/457
2012/0066819 A1 * 3/2012 Carron ..... A62B 17/006 2/456
2015/0004131 A1 * 1/2015 Milstein ..... G21F 3/025 424/85.2
2015/0375019 A1 * 12/2015 VanDerWoude ..... A42B 3/286 128/200.28
2016/0008640 A1 * 1/2016 Teetzel ..... A62B 18/084 128/201.19
2016/0030774 A1 * 2/2016 Graziani ..... A62B 18/04 128/201.25
2016/0030776 A1 * 2/2016 Rolland ..... A41D 13/1184 128/204.25
2016/0165973 A1 * 6/2016 Yazdi ..... A41D 27/28 2/457
2017/0100613 A1 * 4/2017 Chessari ..... A62B 17/04
2020/0206544 A1 * 7/2020 Vaughan ..... A62B 17/04

* cited by examiner

PPE WITH ROTATING ASSEMBLY PROVIDING MULTIPLE FACE COVERS

BACKGROUND OF THE INVENTION

Field of the Invention

This invention is in the field of personal protective equipment for infectious diseases such as airborne viruses.

Description of the Related Art

With the recent worldwide COVID-19 pandemic, there has been intense interest in personal protective equipment. Although the prior art contains numerous examples of various types of biohazard suits, such suits tend to be uncomfortable for prolonged periods. Thus, alternative personal protective equipment (PPE) designs that are more comfortable to wear are desirable.

BRIEF SUMMARY OF THE INVENTION

The invention was inspired, in part, by the insight that prior art facemasks and biohazard suits, at least with regards to the face mask portion, tend to be "one size fits all." However, in addition to differences in height and weight, different users also have quite differing facial structures. The length and width of the human face can vary. This variation can include differences in the size and position of the nose, mouth, and eyes. The structures of the forehead size, jaw size, and other features can also differ. Additionally, some users wear glasses (which themselves can have varying sizes and shapes), and some do not.

Another problem is that prior art facemasks generally bind tightly to various regions of the user's face, causing discomfort on prolonged use. Face shields, on the other hand, tend to trap moisture in the user's breath, leading to fogging and excess condensation.

The invention was also inspired, in part, by the insight that what is needed is an improved biohazard suit type PPE that allows a user to switch between different face shield designs rapidly. According to the invention, if the user is wearing glasses, the user may rapidly configure the PPE device to a face mask side to minimize fogging. If the user has a face with unusual contours, the user may wish to use a face mask side configured to provide ample room. If the user intends to eat or drink, the user may wish to use a face mask side configured to open and shut again as desired.

Thus, as will be discussed, in some embodiments, the invention comprises a PPE device configured with a rotating face cover assembly with a plurality of mask sides. These different mask sides can be configured for different user faces or other use cases. This rotating face cover assembly can be further configured to attach to a zip-up bodysuit that covers the user's entire body, enabling the user to avoid contamination while exposed to airborne infectious agents such as bacteria and viruses. However, by rotating the rotating face cover assembly, the user can rapidly select the mask side best optimized for a given user.

DETAILED DESCRIPTION OF THE INVENTION

Figure 1:
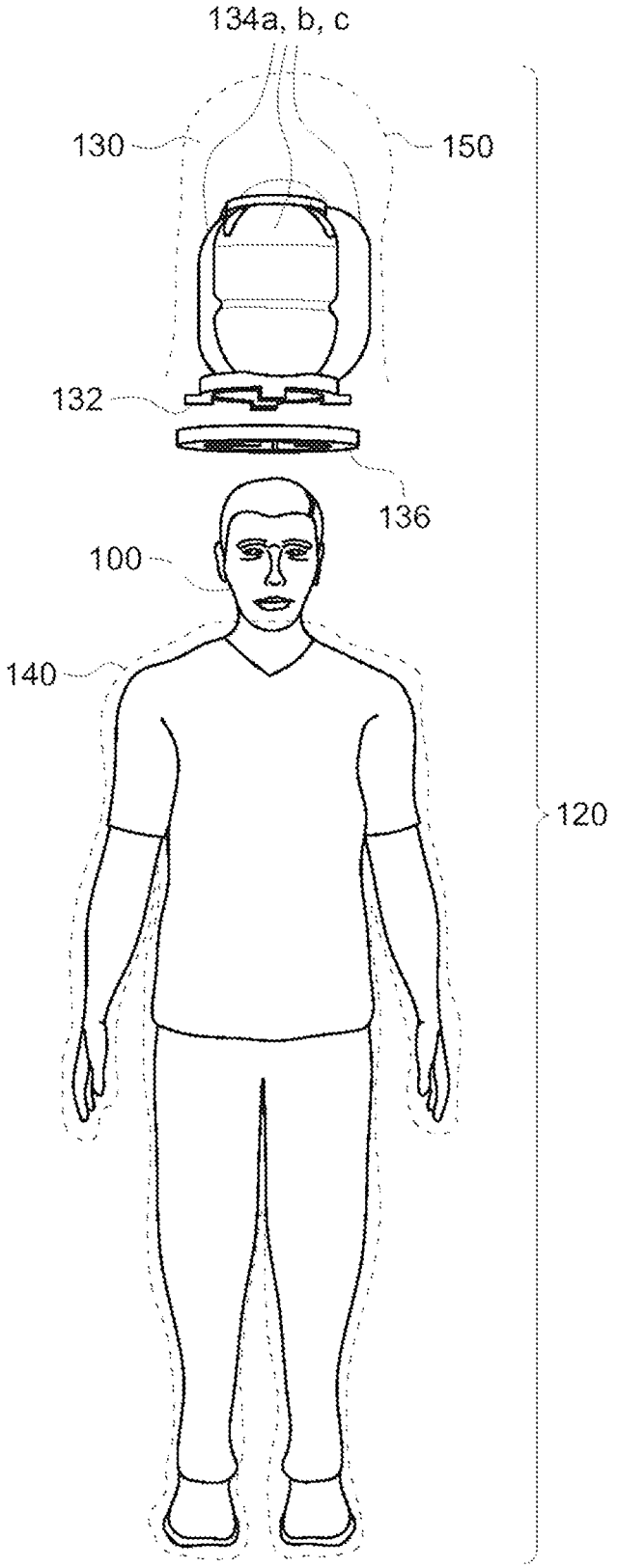
FIG. 1 shows an exploded drawing of a user wearing the invention's PPE device.

FIG. 1 shows an exploded drawing of a user (100) wearing a PPE device (120). This device comprises a rotating face cover assembly (130) with a circular base (132), and a plurality of mask sides (134*a, b, c*). The rotating face cover assembly (130) can be reversibly attached and detached to a circular collar (136). This circular collar is attached to a zip-up bodysuit (140). In use, the user (100) puts on the bodysuit (140), zips up the zippers (see FIG. 6A and FIG. 6B), and then attaches the rotating face cover assembly (130). In some embodiments, the user may also affix an optional hood (150) on top of the rotating face cover assembly (130). This hood (150) may often also be attached to the bodysuit (140). See FIG. 6C for more detail.

Thus, in some embodiments, the invention is a PPE device (120) configured for different types of human users. In addition to differences in their height, weight, these different types of users may also differ in the position or dimensions of their nose, mouth, or eye regions of their faces.

Figure 2A:
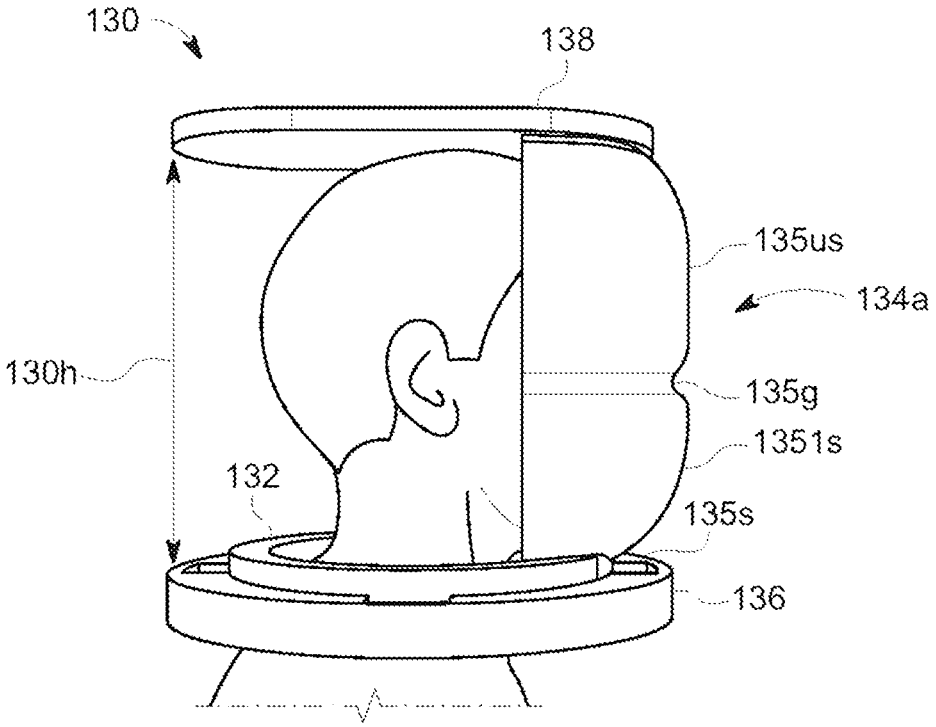
FIG. 2A shows a detail of the rotating face cover assembly.
Figure 2B:
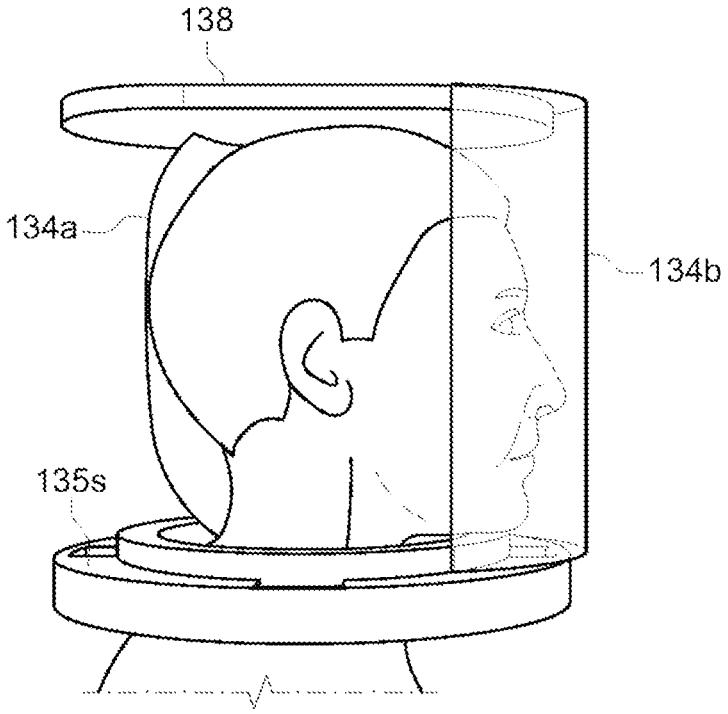
FIG. 2B shows another detail of the rotating face cover assembly.

As previously discussed, and as shown in more detail in FIG. 2A and FIG. 2B, this PPE device will typically comprise a rotating face cover assembly with a circular base (132), a height (130*h*), a plurality of mask sides (134*a*, 134*b*), and a mask top (138), the assembly configured to fit over different types of user's heads and attach to a circular collar (136) in at least one orientation;

Here, the plurality of mask sides (134*a*, 134*b*, 134*c*) are disposed between the circular base (132) and the mask top (138); and are connected to their neighboring mask sides, the circular base (132), and the mask top (138) to form a continuous covering surrounding all sides and head top of different types of user's heads;

In some embodiments, the circular base (132) and the circular collar (136) are configured with an adjustable mechanism enabling different mask sides to be positioned in front of the face of the users.

This adjustable mechanism can be various slots and tabs (135*s*) in the circular base (132) and circular collar (136) that enables the assembly (130) to fit into the circular base at various defined orientations, a sliding mechanism, or other types of mechanism. Here for simplicity, the multiple slots and tabs are shown, positioned at 90-degree angles on the circular base and circular collar.

In some embodiments, each mask side (134*a*, 134*b*, 134*c*) may be configured with a microbial filter element, a transparent element (which form the outline of the mask side itself), and various mask side supporting elements (135*e*) that are configured to shape portions of the surface of the mask side so that, when a user wears the mask, the surface of the mask side does not contact a nose, mouth, or eyes of at least one type of user;

In some embodiments, each different mask side (e.g. 134*a*, 134*b*) may have different mask side supporting elements (135*e*). These enable a first mask side, such as 134*a*, to be optimized to maintain a first set of distances between the mask side and the nose, mouth, or eyes of a first type of human user. Similarly, a different mask side, such as 134*b*, may be optimized to maintain a different set of distances between this other mask side and the nose, mouth, or eyes of a different human user. This allows different users to select among different mask sides (e.g., 134*a*, 134*b*, 134*c*, etc.) that are most comfortable for each user's head geometry, eyewear, or use situation.

FIG. 2A shows a detail of the rotating face cover assembly (130). Although this face cover assembly comprises a plurality of different mask sides typically, in FIG. 2A, only one mask side (134*a*, here shown opaque, although the mask sides are usually transparent) is shown covering the front of the user's face. This mask side has an indented groove (135*g*) positioned above the user's mouth and nose and below the user's eyes. It is intended to act as a partial barrier to help prevent moist air from the user's breath from fogging the user's vision.

FIG. 2A also shows more details of the mask top (138). In some embodiments, this mask top may comprise an air-permeable microbial filter so that the user may obtain at least some outside air through the mask top (138).

In some embodiments, the mask sides may comprise a transparent air-impermeable portion and a non-transparent air-permeable microbial filter. For example, in FIG. 2A, the upper side (135*us*) of the mask (134*a*) may be transparent, while the lower side (134*ls*) of mask 134*a* may comprise an air-permeable microbial filter. In other embodiments, both the upper side and the lower side may include a transparent air-permeable microbial filter.

For example, the non-transparent air-permeable microbial filter (135*ls*) may comprise spunbond-meltblown polypropylene. In situations where both mask sides (135*us* and 135*ls*) include a transparent, air-permeable microbial filter, this transparent air-permeable microbial filter may comprise at least one microporous layer.

FIG. 2B shows another detail of the rotating face cover assembly (130). In this orientation, the previous indented mask (134*a*) side previously shown in FIG. 2A is turned away from the user's face, and here the user is now facing a different mask side (134*b*) that is not indented. Note that this mask side is also not contacting the user's mouth, nose, or eyes.

Figure 3A:
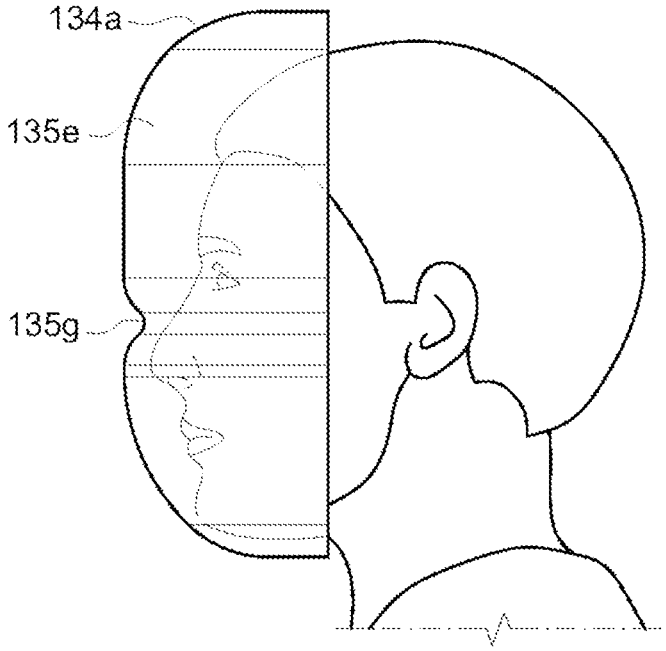
FIG. 3A shows a detail of the indented mask side previously shown in FIG. 2A, with all other elements of the PPE device not shown.

FIG. 3A shows a detail of the indented mask side (134*a*) previously shown in FIG. 2A, with all other elements of the PPE device not shown. This clearly shows how the indented groove (135*g*) is positioned between the user's nose and eyes. It also shows that even the indented mask side (134*a*) does not contact the user's mouth, nose, or eyes. Here the supporting elements (135*e*) may comprise deformation-resistant wires or deformation resistant (e.g., rigid) plastic supports.

Figure 3B:
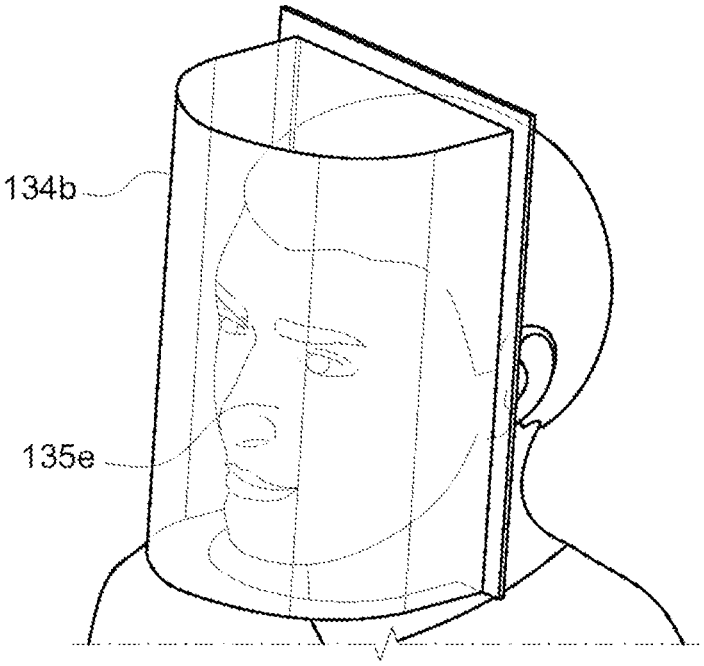
FIG. 3B shows a detail of the different mask side previously shown in FIG. 2B.

FIG. 3B shows a detail of the different mask side (134*b*) previously shown in FIG. 2B. This mask side may also have support elements (135*e*), but they are arranged in a different configuration from those shown in FIG. 3A.

Figure 4A:
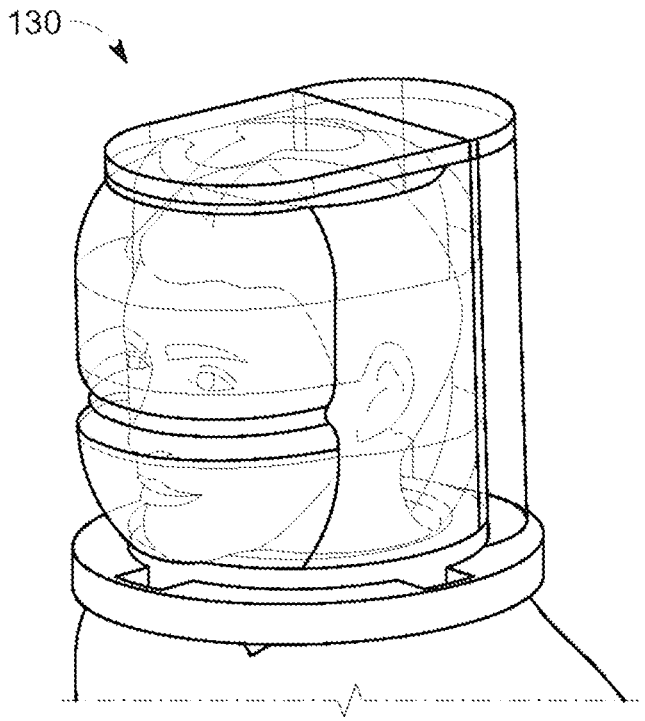
FIG. 4A shows further details of the rotating face cover assembly as the user wears it, showing how one device can comprise a plurality of mask sides.

FIG. 4A shows further details of the rotating face cover assembly (130) as the user wears it, showing how one device can comprise a plurality of mask sides. As previously discussed, the user can rotate the rotating face cover assembly to switch between different mask sides as desired.

Figure 4B:
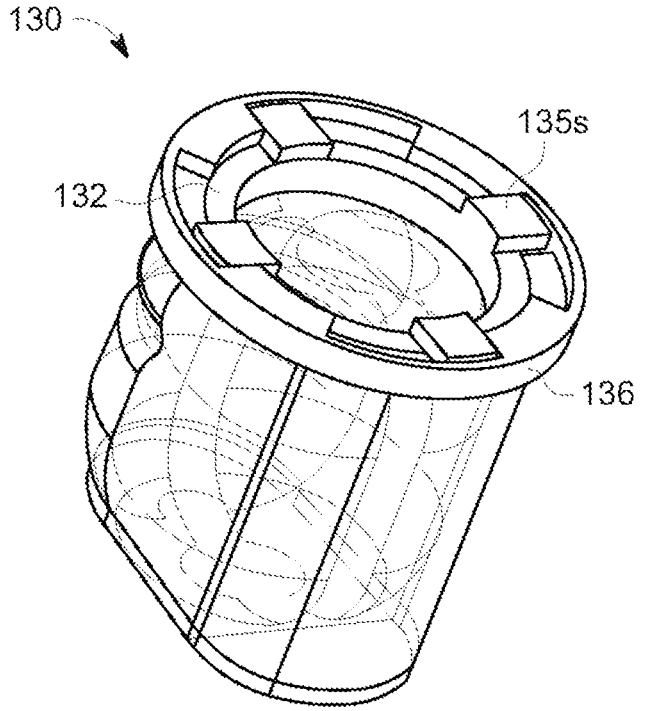
FIG. 4B shows the rotating face cover assembly as seen from the bottom, showing how the circular base can fit into the circular collar (note that the circular collar is normally mounted on the bodysuit, but here is shown by itself for clarity).

FIG. 4B shows the rotating face cover assembly from the bottom, showing how the circular base (132) can fit into the circular collar (136). Note that the circular collar (136) is typically attached to the bodysuit (140), but in FIG. 4B is shown by itself for greater clarity.

In some embodiments, the plurality of mask sides can comprise at least three mask sides (such as 134*a*, 134*b*, 134*c*, etc.), and these three mask sides are disposed along different arc segments of the circular base (132). As previously discussed, this circular base (132) is configured to attach to the circular collar (136) at any of at least three different orientations. Typically, these at least three different orientations are spaced evenly apart along the circular base and circular collar. Alternatively, the circular base (132) can to attach to the circular collar (136) at one orientation. The base can then rotate about the circular collar to position the desired mask side in front of the user's face.

Figure 5B:
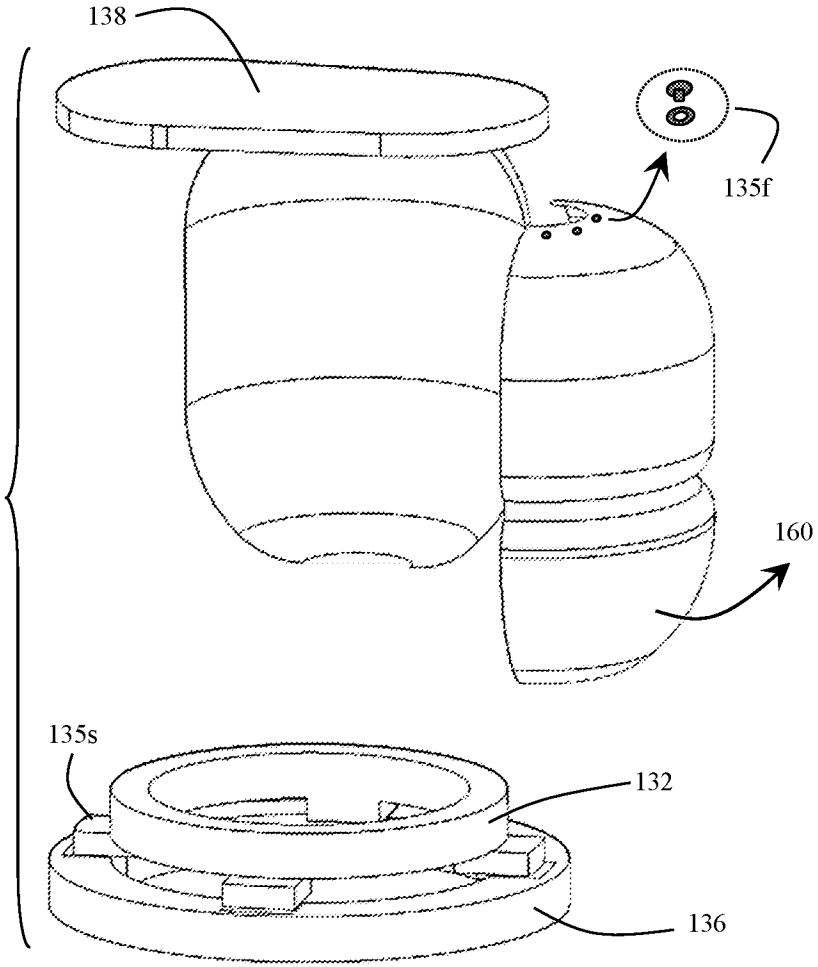
FIG. 5B shows an exploded diagram of the drawing of FIG. 5A.
Figure 5A:
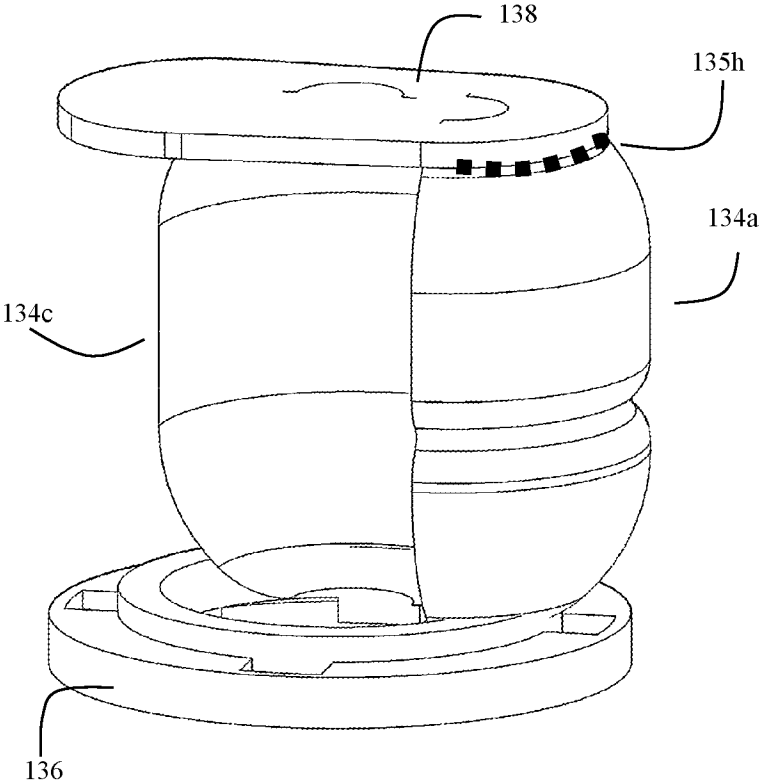
FIG. 5A shows a line drawing of a portion of the rotating face cover assembly showing the top, circular base, circular collar, and two different mask sides.

FIG. 5A shows a line drawing of a portion of the rotating face cover assembly showing the top, circular base, circular collar, and two different mask sides.

FIG. 5B shows an exploded diagram of the drawing of FIG. 5A. In some embodiments, the mask sides may be permanently affixed to the top and circular base. However, in other embodiments, one or more mask sides may be removable. They may be attached or detached from the top, circular base, and the adjacent mask sides by any of buttons, snaps, zippers, or hook-and-loop fasteners. Here snaps (135*f*) are shown.

Note that in some embodiments, at least one of the mask sides may be detachable mask sides. These detachable mask sides may be configured to be attached and detached from the rotating face cover assembly (130) through any of snaps (135*f*), buttons, zippers, or hook-and-loop fasteners. In some cases, the face mask side may be semi-detachable, such as detachable from the circular base, but not detachable from the mask top. Instead the mask side may be attached to the mask top via a hinge (135*h*), so that the mask side may be temporarily raised for the user to eat or drink (160). This mask side can then be closed when the user has finished eating or drinking. Thus, in this embodiment, at least one mask may be configured to be raised and lowered in a "visor style" fashion.

FIG. 5A (135*h*) shows this optional flexible hinge (FIG. 5A, 135*h*) connecting the mask side with the mask top. This hinge, along with a detachable connection with the circular base (such as lower snaps 135*f*), can enable this at least one mask side to temporarily swing away (160) from the circular base and be raised and then lowered and reattached by the user.

In most embodiments, the PPE device (120) is configured so that a first type of human user can adjust a first mask side (such as 134*a*) in front of the first type of human user's face. A different type of human user can adjust a different mask side (such as 134*b*) in front of the different type of human user's face. As previously discussed, the circular collar (136) is attached to a zip-up bodysuit (140). This bodysuit (140) is configured to fit over the user's body. This zip-up bodysuit is typically comprised of microbial impermeable materials (such as a biohazard compatible fabric) to further protect the user from microbial contamination, such as viral contamination, from virus sources outside the user's body.

Figure 6C:
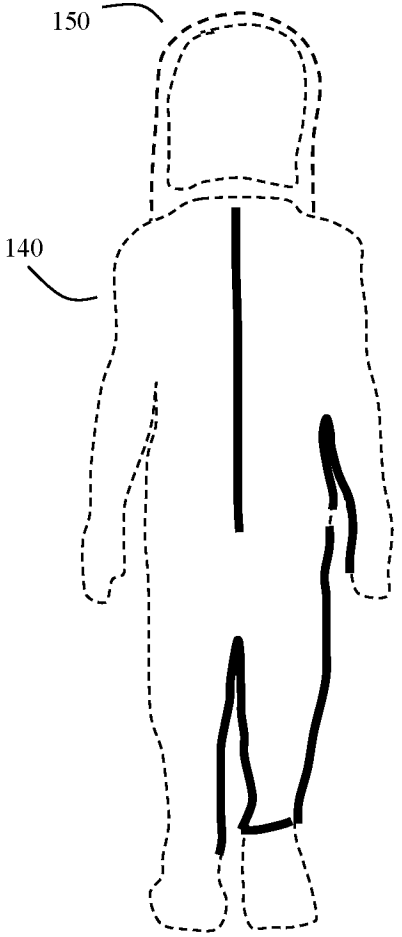
FIG. 6C shows another embodiment of the zip-up bodysuit, here also showing the optional hood that can be configured, regardless of zipper configuration, to extend over the top of the rotating face cover assembly.
Figure 6B:
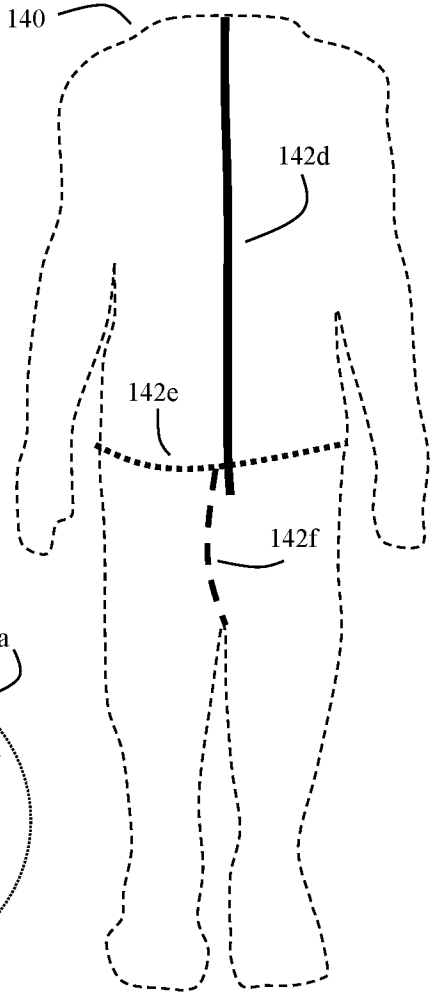
FIG. 6B shows another embodiment of the zip-up bodysuit. Here the bodysuit comprises a front-mounted zipper that extends from the user's waist to the circular collar. Again, the optional hood attachment is not shown.
Figure 6A:
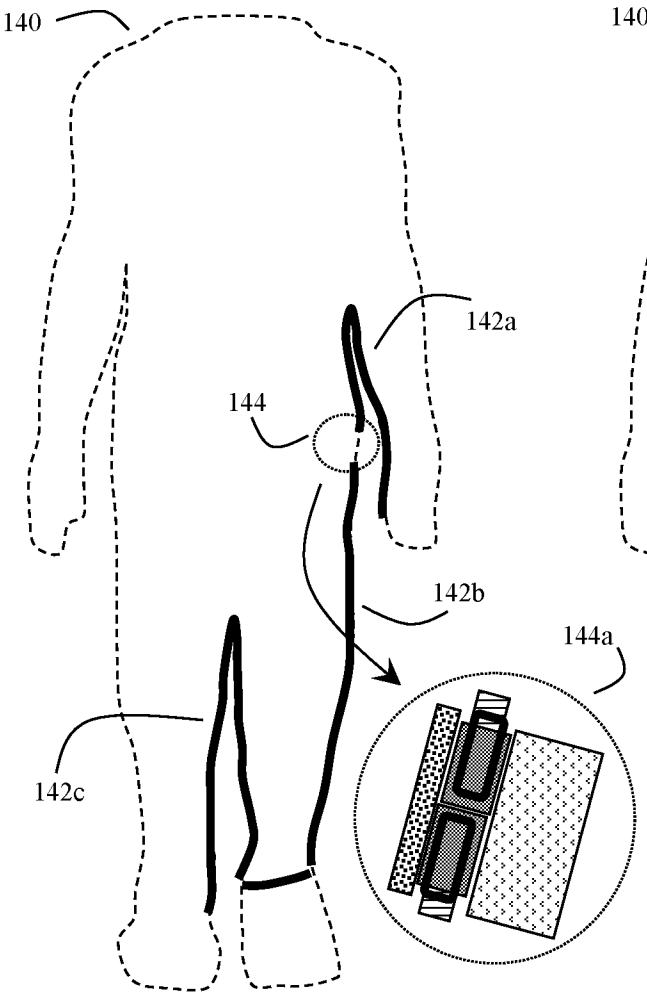
FIG. 6A shows one embodiment of the zip-up bodysuit, in which the bodysuit comprises a plurality of side-mounted zippers that, together, extend from the user's wrist to the user's waist, from the waist to the user's ankle, and from this ankle, across the crouch, and onto the other ankle.

FIG. 6A shows one embodiment of the zip-up bodysuit (140), in which the bodysuit comprises a plurality of side-mounted zippers (142*a*, 142*b*, 142*c*). These zippers, together, extend from the user's wrist to the user's waist (142*a*), and from the user's waist to the user's ankle (142*b*), and from this ankle, across the user's crouch, and onto the user's other ankle (142*c*). Here the optional hood attachment is not shown.

Note that in regions where two zippers join, such as (144), where (142*a* and 142*b*), there may be a need to ensure that the two zippers remain shut and do not leak. This joint region (144) is shown magnified in (144*a*). Here the two zipper heads may be held closed by magnetic clasps or by hook and loop fasteners, such as Velcro® fasteners (144*b*).

Put alternatively, as shown in FIG. 6A, the zip-up bodysuit can comprise a plurality of side-mounted zippers. These zippers can be configured to extend from the wrist of the user to the waist of the user. Then from the waist to the first ankle of the user. The zipper extends from this first ankle to the user's crouch, and finally from the crouch to another ankle. Alternatively, the zip-up bodysuit can comprise a side-mounted zipper configured to extend from the wrist of the user to an ankle of the user.

FIG. 6B shows another embodiment of the zip-up bodysuit. Here the bodysuit comprises a front-mounted zipper (142*d*) that extends from the user's waist to the circular collar. Again, the optional hood attachment is not shown. In other words, in this configuration, the zip-up bodysuit comprises a front-mounted zipper (142*d*) disposed from the circular collar to a crouch of the user. Alternatively, the bodysuit may be a two-piece bodysuit, with a zipper (142*e*) that extends around the waist, separating the bodysuit into an upper half or a lower half. This zipper (142*e*) may also be optionally covered by a belt or waistband, such as a 2-3-inch-wide belt or waistband, as desired. As another embodiment, the bodysuit may have a crouch zipper (142*f*) that allows the crouch area to be completely unzipped for waste removal (sanatory) purposes.

FIG. 6C shows another embodiment of the zip-up bodysuit, here also showing the optional hood that (150) can be configured, regardless of zipper configuration, to extend over the top of the rotating face cover assembly and extend to the suit (140). Put alternatively, in some embodiments, the zip-up bodysuit (140) can comprise a hood element (150 configured to attach to or cover the mask top (138). Although this hood element (150) may be attachable and detachable from the bodysuit (140), in some embodiments, this hood (150) may be permanently attached to the zip-up bodysuit (140).

In still other embodiments, a partially detachable mask may be attached to a hook, button, clasp, or other attachment mechanism that is attached on a hood, so that the detachable may be removed for eating or drinking, yet remain attached to the hood so that the detachable mask will need not be lost.

Velcro® is a registered trademark of Velcro BVBA.

The invention claimed is:

1. A Personal Protective Equipment (PPE) device configured for different human users, said PPE device comprising:

a rotating face cover assembly with a circular base, a height, a plurality of mask sides, and a mask top, each mask side of the plurality of mask sides having a surface, said assembly configured to fit over different user's heads and attach to a circular collar in at least one orientation;

wherein said plurality of mask sides are disposed between said circular base and said mask top; and each of said plurality of mask sides is connected to their neighboring mask sides of the plurality of mask sides, said circular base, and said mask top so as to form a continuous covering surrounding all sides and head top of different user's heads;

said circular base and said circular collar configured with an adjustable mechanism enabling different mask sides of the plurality of mask sides to be positioned in front of a face of said different users;

each said mask side of the plurality of mask sides configured with a microbial filter element, a transparent element, and mask side supporting elements configured to shape portions of said surface of each said mask side of the plurality of mask sides so that, when said rotating face cover assembly is worn by a user, said surface of each said mask side of the plurality of mask sides does not contact a nose, mouth, or eyes of at least one user;

wherein each mask side of the plurality of mask sides has different mask side supporting elements so that a first mask side of the plurality of mask sides maintains a first set of distances between said first mask side and said nose, mouth, or eyes of a first human user, and so that a second mask side of the plurality of mask sides that is different from the first mask side maintains a second set of distances that are different from the first set of distances between said second mask side and said nose, mouth, or eyes of a different human user;

said PPE device configured so that a first human user is able to adjust the first mask side in front of said first human user's face, and a different human user is able to adjust said second mask side in front of said different human user's face;

said circular collar attached to a zip-up body suit configured to fit over a body of said users, said zip-up body suit comprising microbial impermeable materials.

2. The device of claim 1, wherein said plurality of mask sides comprise at least three mask sides, and said at least three mask sides are disposed along different arc segments of said circular base.

3. The device of claim 2, wherein said circular base is configured to attach to said circular collar at any of at least three different orientations, said at least three different orientations are spaced evenly apart.

4. The device of claim 1, wherein said circular base is configured to attach to said circular collar at one orientation, and said circular base is configured to rotate about said circular collar.

5. The device of claim 1, wherein the transparent element comprises a transparent air impermeable portion, and the microbial filter element comprises a non-transparent air permeable microbial filter.

6. The device of claim 5, wherein said non-transparent air permeable microbial filter comprises spunbond-meltblown polypropylene.

7. The device of claim 1, wherein the microbial filter element comprises a transparent, air-permeable microbial filter.

8. The device of claim 7, wherein said transparent, air-permeable, microbial filter comprises at least microporous layer.

9. The device of claim 1, wherein said supporting elements comprise deformable resistant wires or deformable plastic supports.

10. The device of claim 1, wherein said supporting elements are configured to reduce moisture condensation from fogging said user's vision.

11. The device of claim 10, wherein a hood element is attached to said zip-up body suit.

12. The device of claim 1, wherein said zip-up body suit comprises a hood element configured to attach to or cover said mask top.

13. The device of claim 1, wherein said zip-up body suit comprises a plurality of side mounted zippers configured to extend from a wrist of said user to a waist of said user, from said waist to a first ankle of said user, from said first ankle to a crouch of said user, and from said crouch to another ankle of said user.

14. The device of claim 1, wherein said zip-up body suit comprises a side mounted zipper configured to extend from a wrist of said user to an ankle of said user.

15. The device of claim 1, wherein said zip-up body suit comprises a front-mounted zipper disposed from said circular collar to a crouch of said user.

16. The device of claim 1, wherein at least one of said mask sides are detachable mask sides, and wherein the at least one mask side is configured to be attached and detached from said rotating face cover assembly by way of either snaps, buttons, zippers, or hook-and-loop fasteners.

17. The device of claim 1, wherein said different human users differ in position or dimensions of said nose, mouth, and/or eyes.

18. The device of claim 1, wherein said mask top comprises an air permeable microbial filter.

19. The device of claim 1, wherein at least one mask side of the plurality of mask sides further comprises a flexible hinge connecting said at least one mask side with said mask top, and wherein said at least one mask side is configured to both attach and detach from said circular base.

* * * * *